United States Patent [19]

Hemphill

[11] 4,098,013

[45] Jul. 4, 1978

[54] DIGGING TOOTH WITH REPLACEABLE CUTTING EDGE

[76] Inventor: Charles Wayne Hemphill, 1106 Green Valley La., Duncanville, Tex. 75116

[21] Appl. No.: 817,734

[22] Filed: Jul. 21, 1977

Related U.S. Application Data

[63] Continuation-in-part of Ser. No. 715,560, Aug. 18, 1976, Pat. No. 4,037,337.

[51] Int. Cl.[2] ..... E02F 9/28

[52] U.S. Cl. ..... 37/142 R; 172/719

[58] Field of Search ..... 37/141, 142 R, 142 A, 37/103; 172/719

[56] References Cited

U.S. PATENT DOCUMENTS

| | | | |
|---|---|---|---|
| 305,800 | 9/1884 | Cox | 37/142 R |
| 1,003,663 | 9/1911 | Skelton | 37/142 A |
| 1,870,044 | 8/1932 | Fellmeth | 37/142 R |
| 2,666,272 | 1/1954 | Everett | 37/142 R |
| 3,049,824 | 8/1962 | McIninch | 37/142 R |
| 3,397,012 | 8/1968 | Krekeler | 37/142 X |
| 3,462,861 | 8/1969 | Kampert | 37/142 R |
| 3,655,244 | 4/1972 | Swisher | 37/142 R X |
| 4,028,823 | 6/1977 | Edwards | 37/142 R |

*Primary Examiner*—E. H. Eickholt
*Attorney, Agent, or Firm*—Marcus L. Bates

[57] ABSTRACT

A digging tooth for a backhoe bucket. The tooth has a main body and a replaceable cutting edge in the form of a nose piece. The replaceable nose piece has a ground engaging end spaced from the opposed end which engages the main body. The main body has a leading end spaced from a trailing end. The trailing end of the main body is mounted to the leading end of a backhoe bucket in the usual manner. The leading end of the main body is made into a configuration which releasably engages the nose piece in such a manner that the nose piece can be replaced whenever the cutting edge thereon becomes worn.

12 Claims, 11 Drawing Figures

DIGGING TOOTH WITH REPLACEABLE CUTTING EDGE

REFERENCE TO RELATED PATENT APPLICATIONS

This patent application is a Continuation-in-Part of patent application Ser. No. 715,560 filed Aug. 18, 1976, now U.S. Pat. No. 4,037,337 issued July 26, 1977.

BACKGROUND OF THE INVENTION

One of the major expenses associated with operation of a backhoe machine is the costly replacement of the digging teeth located on the digging bucket thereof. Replacement of the digging teeth also requires shutdown of the machine and a considerable amount of a technician's time is involved in removing the old teeth and substituting new teeth therefor.

During heat treating of the cast metal, the manufacturer of digging teeth must compromise between the hardness of the cutting edge and the brittleness of the tooth body, because a highly brittle metal will break when engaging hard rock and the like. Therefore, a tooth made sufficiently hard to cut rock will often break and for this reason a compromise in ductility must be made while carrying out heat treatment of the teeth.

Accordingly, it is desirable to be able to make the cutting edge of a digging tooth associated with excavating machines such as backhoe buckets, for example, of very hard material while the rest of the tooth is made of ductile material. It is desirable that the hard cutting edge be removably affixed to the relatively ductile main body of the digging tooth in such a manner that only the marginal leading end which forms a cutting edge need be replaced from time to time in order to restore the digging tooth.

SUMMARY OF THE INVENTION

This invention relates to excavating equipment, and specifically to a backhoe bucket digging tooth which includes a main body having a replaceable cutting edge thereon. The cutting edge is fabricated in the form of a nose piece which can be replaced from time to time. The nose therefore has a ground engaging cutting edge which is spaced from the main body engaging end. The main body of the tooth has a leading end spaced from a trailing end thereof so that the trailing end can be conveniently mounted to the leading edge of a backhoe bucket. The forward end of the tooth main body receives the main body engaging end of the nose in such a manner that the nose is removably mounted to the leading end of the digging tooth and can thereby be replaced from time to time in order to restore the cutting efficiency of the tooth.

In a more specific form of the invention, the leading end of the main body of the tooth is in the form of a stump which is received in close tolerance relationship within a socket formed within the nose piece thereby enabling the socket and stump to be received one within the other. The main body includes a recess in the form of a dimple which admits the sidewall of the nose to be deformed thereinto, thereby fastening the stump and socket together in a releasable manner.

In one form of the invention, the digging tooth includes spaced, forwardly directed stumps, each of which removably engages a nose, thereby providing a digging tooth having a bifurcated leading end.

In another specific embodiment of the invention, a lateral cutting edge is included rearwardly of the nose to thereby provide the tooth with primary and secondary digging elements.

Accordingly, the primary object of this invention is the provision of a digging tooth having a replaceable cutting edge thereon.

Another object of the invention is to provide a digging tooth having a replaceable cutting edge thereon so that the cutting edge can be made much harder than the main body of the tooth.

A further object of this invention is to disclose and provide a digging tooth having spaced ground engaging elements at the forward end portion thereof which removably receives a cutting member thereon.

A still further object of this invention is to provide a digging tooth having a primary and secondary cutting edge, with the primary cutting edge being in the form of a replaceable nose which can be replaced in order to restore the cutting efficiency of the tooth.

Another and still further object of this invention is to provide a digging tooth having a primary ground engaging member and a secondary ground engaging member, with the secondary ground engaging member lying laterally respective to the primary member, and with the primary member having a replaceable cutting edge in the form of a nose piece which is removably mounted thereon.

An additional object of the present invention is the provision of a digging bucket having a V-shaped leading edge with teeth mounted thereon, each said tooth having replaceable dual cutting elements affixed thereto.

Still another object of the present invention is the provision of a digging tooth having a relatively hard replaceable cutting edge mounted to a relatively ductile main body which admits the main body being welded directly to the bucket lip.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
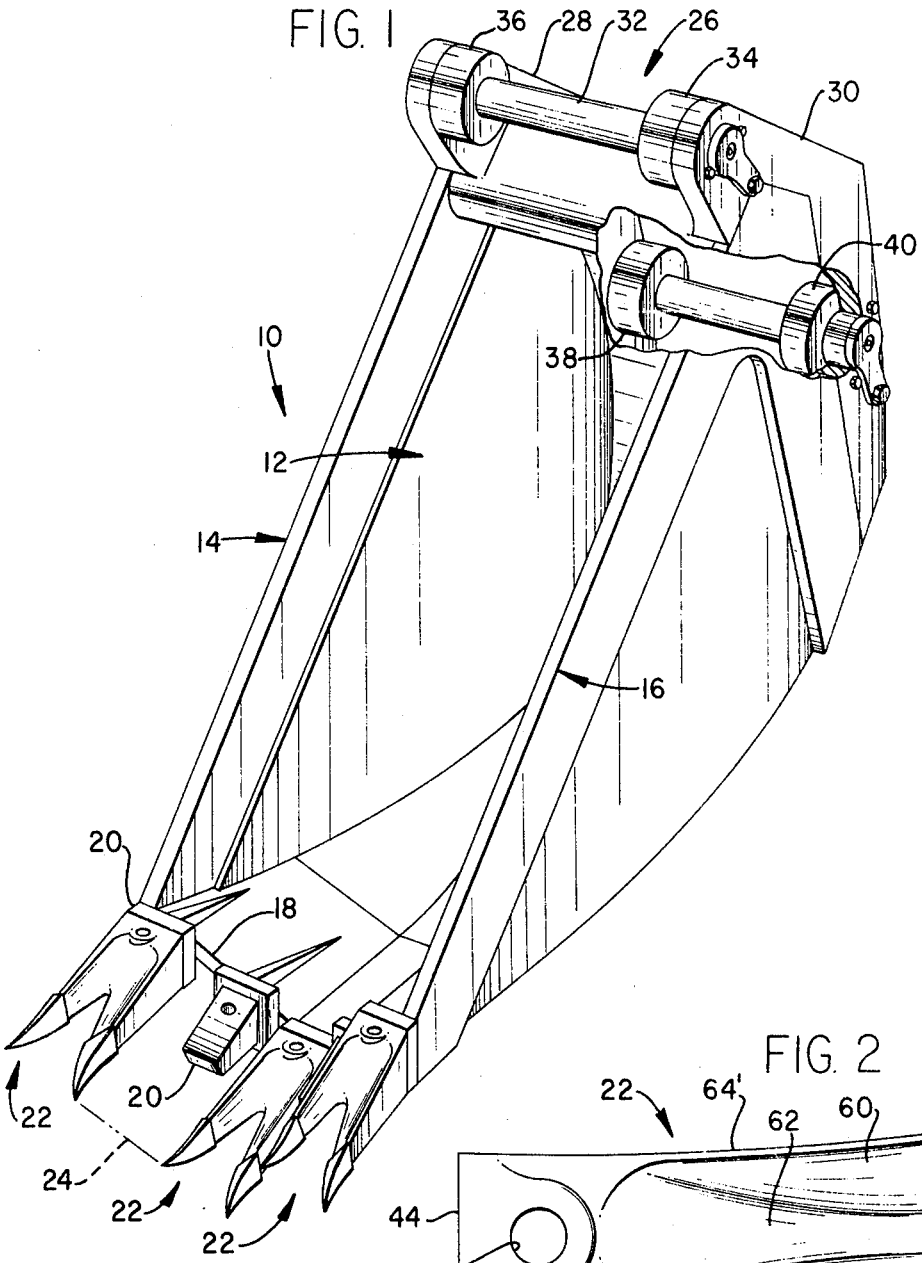
FIG. 1 is a front, perspective view of a backhoe digging bucket having teeth mounted thereon made in accordance with one embodiment of this invention.

FIG. 1 discloses a bucket 1 made in accordance with my previous U.S. Pat. No. 4,037,337 issued July 26, 1977, of which this application is a continuation-in-part. The interior of the bucket 12 is formed by sides 14 and 16 which are connected to a V-shaped lip 18 which forms the leading edge of the bucket. A plurality of tooth receiving shanks 20 are rigidly affixed to the bucket lip with each of the shanks receiving thereon a digging tooth 22 made in accordance with the present invention. The leading edge of the teeth jointly form an imaginary line 24.

The rear or trailing end of the bucket is provided with a lift assembly made in accordance with my previously filed patent application Ser. No. 817,733, filed July 21, 1977. The lift assembly includes spaced apertured ears 28 and 30 rigidly affixed to the bucket so that various different diameter pins 32 can be fitted into various different sizes of bushings 34 and 36, which in turn are fitted into the apertures of the lifting ears. Bushings 38 and 40 are similarly received in spaced relationship to the aforementioned bushings.

Figure 2:
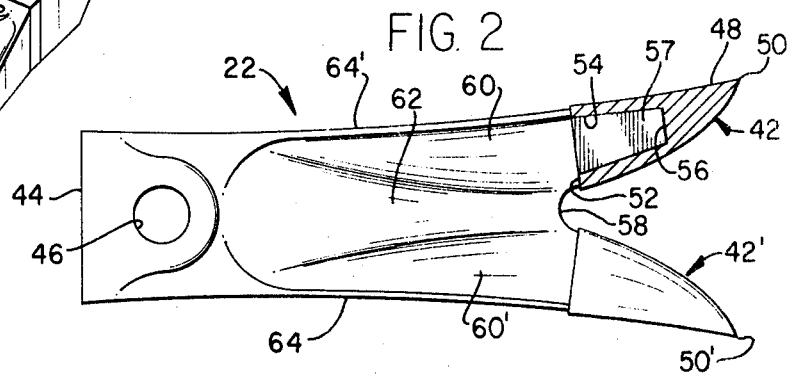
FIG. 2 is an enlarged, part cross-sectional, top view of a digging tooth made in accordance with the present invention.
Figure 3:
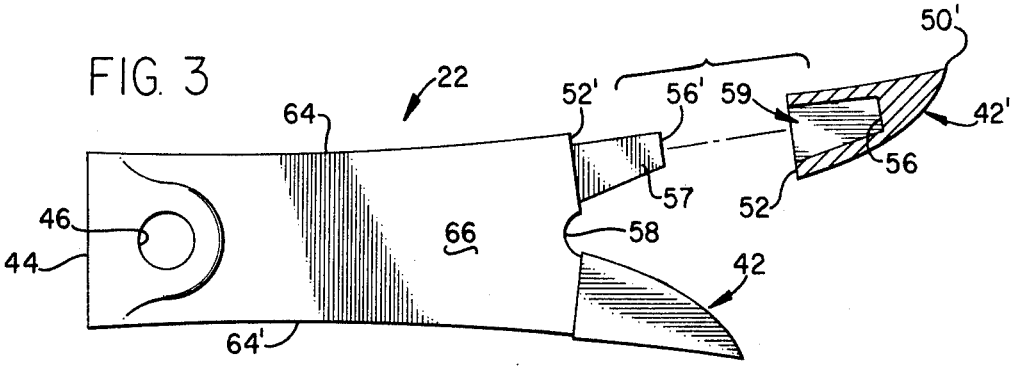
FIG. 3 is a bottom view of the tooth disclosed in FIG. 2.
Figure 4:
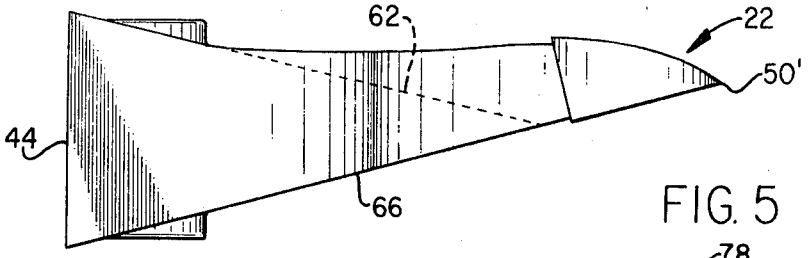
FIG. 4 is a side elevational view of the tooth disclosed in FIGS. 2 and 3.

As best seen illustrated in FIGS. 2–4, the digging tooth of the present invention includes a ground engaging leading edge 42 and 42′ spaced from a trailing end 44. Mount means which includes an aperture 46, secures the tooth in a removable manner to the before mentioned shank. Other mount means, including direct welding, can be employed to rigidly affix the tooth to the lip or leading edge of the bucket.

The digging tooth includes a main body member and a cutting edge in the form of a replaceable nose piece 48. The replacement nose terminates in a forward direction in a point 50. A rear wall 52 defines the entrance of a socket formed into the nose. The socket has walls 54 and terminates at bulkhead 56.

The forward marginal end of the digging tooth is reduced in size to present a stump 57. The stump commences adjacent to entrance 52 and terminates in abutting relationship respective to the bulkhead 56.

The embodiment of FIGS. 2–4 includes spaced diverging stumps connected by a secondary member 58. One side 60 of the tooth is sloped downwardly toward a central portion 62 thereof, with the central portion being an upwardly sloped continuation of the secondary cutting edge 58. The opposed primary member likewise includes a sloped wall 60′ which downwardly converges toward wall 60 and into engagement with the wall 62 of the secondary digging element.

Sidewalls 64 and 64′ preferably are curved outwardly away from one another in the illustrated manner of the drawings, with the main body of the tooth being essentially solid and made of relatively ductile steel as compared to the relatively harder nose 48.

Figure 5:
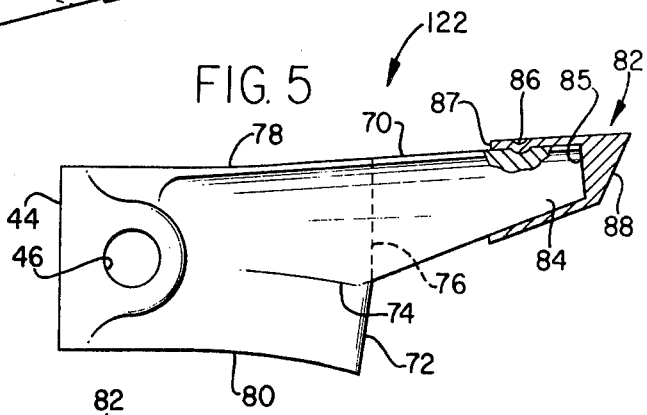
FIG. 5 is a part cross-sectional top plan view of another form of a digging tooth made in accordance with the present invention.
Figure 6:
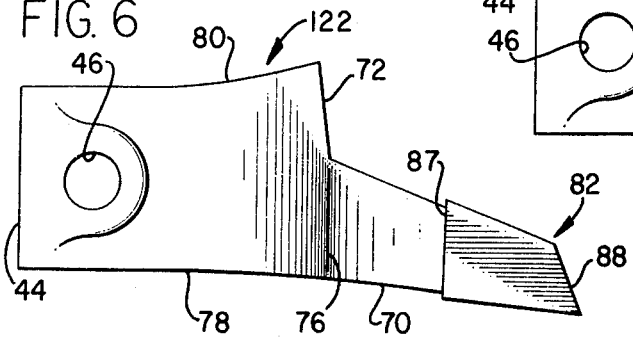
FIG. 6 is a bottom view of the digging tooth disclosed in FIG. 5.
Figure 7:
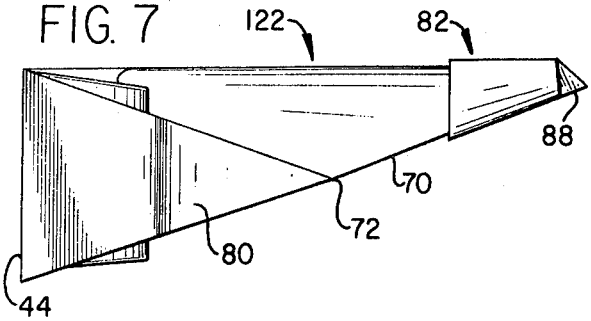
FIG. 7 is a side elevational view of the digging tooth disclosed in FIGS. 5 and 6.

The embodiment of the digging tooth disclosed in FIGS. 5–7 is provided with a primary digging member 70 arranged forwardly of the trailing end thereof with there being a laterally arranged secondary cutting member 72 which joins the primary member along the indicated area 74. Numeral 76 indicates the line of inclination of an inclined portion of the primary member. The tooth includes opposed diverging sidewalls 78 and 80.

The tooth of FIGS. 5–7 has a replaceable cutting edge in the form of a removable nose 82. The main body terminates in a stump 84 which is removably received within the socket of the nose. The terminal end 85 of the socket and stump abuttingly engage one another. The stump includes a fastener means in the form of a dimple which is formed therein so that the sidewall of the socket can be deformed thereinto, thereby releasably affixing the nose to the stump. An alternate fastener means, which is less preferable to the dimple, is an aperture formed through both the stump and the socket, with the apertures being slightly misaligned, so that a rolled pin can be driven into the apertures to securely fasten the nose to the main body. The nose includes a rear entrance 87 and a forward cutting edge 88.

Figure 10:
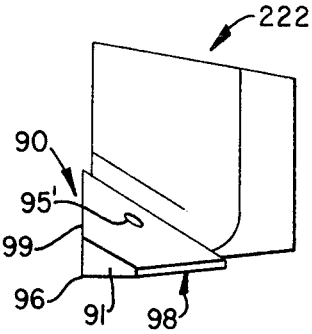
Figure 8:
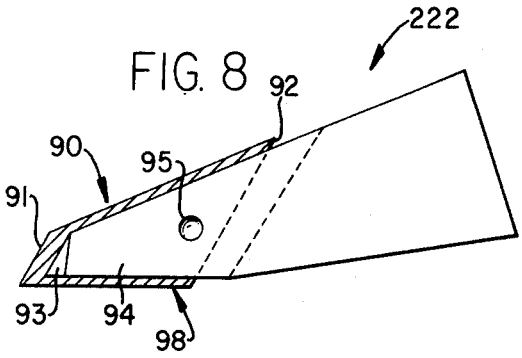
FIG. 8 is a part cross-sectional, side elevational view of still another form of the present invention.
Figure 9:
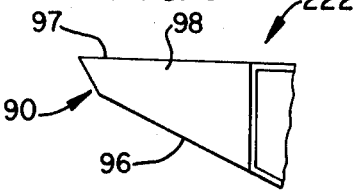
FIG. 9 is a fragmented, side elevational view of the digging tooth disclosed in FIG. 8; and, FIG. 10 is a front view of the digging tooth disclosed in FIG. 8.

In the embodiment disclosed in FIGS. 8–10, a digging tooth 222 is provided with a removable cutting edge in the form of a nose 90 which is removably affixed to the illustrated main tooth body. The nose has a cutting end 91 spaced from a trailing end 92, with the trailing end forming the entrance into the socket 93. The stump 94 is wedgedly received within the socket and includes a fastener means in the form of dimple 95. The lower edge 96 is spaced from the upper edge 97 by the sidewall 98. The tooth body can be welded directly to the bucket lip, if desired, thereby eliminating the usual shank and the fastener means by which the tooth would otherwise be fastened to the lip.

In operation, the main body of the tooth is rigidly affixed to the bucket leading edge in the orientated manner of FIG. 1, with the replaceable cutting edge being attached to the forward end of the main body. The replaceable cutting edge can be made extremely hard as compared to the cutting edge of prior art digging teeth, and therefore, the cutting edge of the instant tooth will retain its sharpness for a much longer time thereby increasing the efficiency of the teeth. The main tooth body can be heat treated to impact ductile properties thereinto, thereby avoiding fatigue cracking and the consequent breakage of the main tooth body. This unexpected advantage of providing a digging bucket with a two or three part digging tooth having a replaceable cutting edge in the form of a nose and a relatively ductile main body has several unforseen results. Namely, the aforementioned breakage of the digging tooth is reduced to a minimum, while the cost of operation is also reduced, not only from less breakage of teeth, but also from the ability of the operator to be able to renew the cutting edge on the tooth rather than undergoing the expense of replacing the entire massive digging tooth. Furthermore, since the cutting edge on the nose piece is harder, it retains its sharpness longer.

In one embodiment of the present invention, all of the digging teeth on the leading edge of the bucket are double pronged as illustrated in FIGS. 1 and 2–4. In another embodiment of the invention, only the central tooth (attached to the keel) is double pronged while the teeth on either side of the bucket lip are made into the configuration illustrated in FIGS. 5–7 or 8–9. It is considered within the comprehension of this invention to provide two teeth such as illustrated in FIGS. 5–10 at the central portion of the bucket, and with the teeth located on one side of the bucket being mirror images of the teeth located on the other side of the bucket.

As the digging teeth become dull and lose their efficiency, a mechanic drives the nose from the main body of the tooth, slips a new nose into place, and deforms the wall of the socket into the dimple formed within the stump. The socket is provided with indicia which indexes the outer wall surface of the socket with the location of the dimple in the stump so that a punch or the like can be used for effecting the deformation of the socket wall.

Another unexpected result of the present invention is the provision of a main body being imparted with a hardness which enables it to be directly welded to the lip of the bucket, and which will be able to withstand harsh abuse without fatigue cracking. Heretofore, the extremely hard tooth body has developed fractures along the weld and for this reason the teeth could not be satisfactorily welded directly to the leading edge of the bucket.

Furthermore, prior art teeth, when heat treated to the optimum hardness, especially tend to crack wherever holes may be formed therein. The present invention avoids formation of cracks because of the ductility of the main body.

While other fastener means can be employed by which the nose is removably affixed to the stump, it is preferred to avoid employing drilled passages and holes into the nose of the tooth in order to avoid encouragement of cracks and fractures. Furthermore, the relationship of the stump and socket can be reversed while remaining within the comprehension of this invention.

Figure 11:
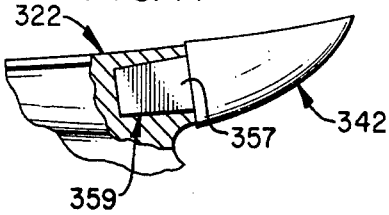
FIG. 11 sets forth still another embodiment of the digging tooth disclosed in the foregoing figures of the drawings.

This is illustrated in FIG. 11 wherein the nose piece is provided with a stump which rearwardly extends into cooperative engagement with the socket. The socket is seen to be formed within the leading marginal end portion of the main body. The socket receives the stump in close tolerance relationship therewithin so that the cutting edge is secured thereto until it needs to be replaced.

In order to achieve the desired hardness of the cutting edge while retaining the suitable ductile properties of the main body, it is considered part of this invention to employ special alloys in fabricating the nose, such as vanadium and the like, while the main body is made of low carbon steel, or the like. Separate heat treatment should be effected upon the nose piece and main body in order to realize the maximum advantages from the invention.

I claim:

1. A digging tooth for attachment to the lip of an excavating bucket, said tooth having a leading end spaced from a trailing end;

a shank formed at said trailing end by which said tooth can be affixed to the lip of the excavating bucket; a ground engaging member formed at said leading end so that movement of the tooth in a direction towards said leading end enables said tooth to engage the ground and excavate material therefrom;

said ground engaging member includes a penetrating member and a secondary member, said penetrating member extends forward of said secondary member;

said secondary member has a forward, ground engaging edge and an upper face, said upper face commences at said edge and upwardly slopes towards said trailing end;

opposed sidewalls, said penetrating member and said secondary member each have one of said opposed sidewalls; said penetrating member has an upper face which commences at one said sidewall and slopes downward towards said face of said secondary member; said penetrating member is progressively reduced in cross-section towards the leading end thereof and terminates in a cutting end;

said ground engaging edge of said secondary member includes a forward terminal end portion in the form of a cutting edge;

a wall, said cutting end of said penetrating member and said cutting edge of said secondary member are spaced from one another by the last said wall with the last said wall being spaced from each of said opposed walls;

the marginal forward end of said penetrating member being in the form of a replaceable nose, means forming the marginal rear end of said penetrating member into a mount means by which said nose is mounted to the forward end of said tooth;

a socket which includes a stump and a cavity with the socket being received within said cavity in close tolerance relationship therewith;

one of said stump and said cavity being formed on the forward marginal end of said marginal rear end of said penetrating member while the other of said stump and said cavity is formed at a rear marginal end of said nose;

whereby said nose can be replaced should the cutting end thereof become worn.

2. The tooth of claim 1 wherein said cutting end is in the form of a chisel which has a cutting edge formed thereon; said sidewall of said penetrating member includes a continuous, relatively long wall which extends from said shank to said chisel;

the sidewall of said secondary member includes a relatively short wall spaced from said first sidewall by the forward terminal end of said penetrating and secondary members; an inclined cutting edge which extends forwardly from said secondary member to said chisel and defines a side of said penetrating member which is nearest adjacent to said secondary member.

3. The tooth of claim 1 wherein said penetrating member includes an edge portion which is opposed to said sidewall thereof and which is placed diagonally respective to said opposed sidewalls and which interconnects said cutting end and said cutting edge.

4. The tooth of claim 3 wherein said opposed sidewalls are divergent in a direction towards said leading end of the tooth such that said opposed sidewalls curve away from one another.

5. The tooth of claim 1 which includes two of said penetrating members which are mirror images of one another and spaced from one another by said secondary member.

6. The tooth of claim 1 wherein said stump is formed on said nose while said cavity is formed in said marginal rear end of said penetrating member.

7. The tooth of claim 1 wherein said cavity is formed on said nose while said stump is formed on said marginal rear end of said penetrating member.

8. A digging tooth made into a configuration to present a leading end spaced from a trailing end; a shank formed at said trailing end by which said tooth can be affixed to a digging implement, such as a backhoe bucket, for example; a ground engaging member formed at said leading end so that movement of the tooth in a direction towards said leading end enables said tooth to engage the ground and excavate material therefrom;

said ground engaging member includes a pilot member and a secondary member integrally affixed to one another; said pilot member commences adjacent to said secondary member and extends forward of said secondary member; said pilot member has a forward marginal end and a rear marginal end portion;

the forward terminal end of said secondary member is in the form of a ground engaging cutting edge and further includes an upper face which commences at said cutting edge and slopes upwardly towards said trailing end;

the width of said tooth being defined by opposed sidewalls, each of which extend from said trailing end towards said leading end, one of said sidewalls being relatively long and defining one side of said pilot member, the other of said sidewalls being relatively short and defining one side of said secondary member; said pilot member has an upper face which commences at one of said sidewalls and slopes downward towards said secondary member, thereby causing the sidewall located on the pilot member to be greater in height and length as compared to the sidewall located on said secondary member; said pilot member is progressively reduced in cross-section towards the leading end thereof and terminates in a cutting end;

said ground engaging cutting edge of said secondary member extends substantially laterally of the tooth;

said cutting end of said pilot member and said cutting edge of said secondary member are spaced from one another by another wall, with the last said wall being spaced from each of said opposed walls;

the forward marginal end of said pilot member is in the form of a replaceable nose, mount means by which said replaceable nose is affixed to the rear marginal portion of said pilot member; and a fastener means included in said mount means by which said nose is secured to said rear marginal portion of said pilot member.

9. The tooth of claim 8 wherein there are two pilot members which are spaced from one another by said secondary member, said two pilot members are mirror images of one another.

10. The tooth of claim 8 wherein said pilot member includes an edge portion which is opposed to said sidewall thereof and which is placed diagonally respective to said opposed sidewalls and which interconnects said cutting end and said cutting edge.

11. The tooth of claim 8 wherein said nose has a cavity formed within the rear marginal end thereof, the forward marginal end of said rear marginal portion of said pilot member is in the form of a socket which is received in close tolerance relationship within said cavity, thereby forming said mount means.

12. The tooth of claim 8 wherein said nose terminates in a socket at the rear marginal end thereof, said rear marginal portion of said pilot member has a socket receiving cavity formed therein, said socket and said cavity form said mount means.

* * * * *

UNITED STATES PATENT OFFICE

CERTIFICATE OF CORRECTION

Patent No. 4,098,013 Dated July 4, 1978

Inventor(s) CHARLES WAYNE HEMPHILL

It is certified that error appears in the above-identified patent and that said Letters Patent are hereby corrected as shown below:

Column 1, line 66, insert --diverging-- before "forwardly";
Column 3, line 11, "bucket 1" should read --bucket 10--;
Column 3, line 42, "replacement" should read --replaceable--

Signed and Sealed this

*Third* Day of *April 1979*

[SEAL]

*Attest:*

RUTH C. MASON
*Attesting Officer*

DONALD W. BANNER
*Commissioner of Patents and Trademarks*